United States Patent [19]

Glass

[11] 4,056,955

[45] Nov. 8, 1977

[54] IGNITION LOCK

[75] Inventor: Dwight W. Glass, Rockford, Ill.

[73] Assignee: Keystone Consolidated Industries, Inc., Peoria, Ill.

[21] Appl. No.: 695,129

[22] Filed: June 11, 1976

[51] Int. Cl.[2] ..... E05B 63/00

[52] U.S. Cl. ..... 70/422; 70/375; 70/421

[58] Field of Search ..... 70/373, 372, 374, 375, 70/416, 419, 421, 422, 418, 432

[56] References Cited

U.S. PATENT DOCUMENTS

| | | | |
|---|---|---|---|
| 1,546,626 | 7/1925 | Crouch | 70/422 UX |
| 1,789,757 | 1/1931 | Jacobi | 70/432 X |
| 2,609,679 | 9/1952 | Bremer | 70/422 X |
| 3,425,248 | 2/1969 | Duval | 70/421 |

FOREIGN PATENT DOCUMENTS

| | | | |
|---|---|---|---|
| 1,533,953 | 6/1968 | France | 70/421 |

*Primary Examiner*—Robert L. Wolfe

*Attorney, Agent, or Firm*—Allegretti, Newitt, Witcoff & McAndrews

[57] ABSTRACT

An automobile ignition lock includes a plug with a plurality of tumblers. The plug is rotatably mounted in a cylinder and includes a slot for receipt of a tumbler actuating key. A key bolt is positioned at the inner end of the key slot and is movable in response to insertion of the key in the key slot from a plug locking to a plug unlocking position. Excessive longitudinal transfer or movement of the key bolt relocks the plug and cylinder and prevents relative rotation. Thus, a key with appropriate bitting and of appropriate length must be used to effect unlocking of the plug from the cylinder. As an additional security feature of the lock, the plug is designed with a circumferential slot that fractures and separates the plug into two separate portions when an attempt is made to forceably rotate the plug relative to the cylinder.

2 Claims, 3 Drawing Figures

IGNITION LOCK

BACKGROUND OF THE INVENTION

This invention relates to an improved lock and more particularly to an improved lock especially useful as part of an automotive ignition system to provide increased security for the system.

The ignition lock for an automobile is normally incorporated as part of the steering column. The lock is generally a key tumbler operated lock of the type including a cylinder with a rotatable plug mounted therein. Tumblers within the plug are operated in response to a properly bitted key inserted into a slot in the plug. Insertion of the proper key moves the tumblers and thereby permits rotation of the plug and operation of the ignition system and other key operated systems of the automobile.

Automobile theft can often be prevented with appropriate security features built into the ignition lock. Originally, of course, the idea of using a key operated ignition system was the security feature utilized to prevent automobile theft. However, numerous tools including lock picks and the like were designed to circumvent the protection afforded by a key operated ignition system. Also, lock pullers have been used to pull the lock from the automibile steering column or dashboard so that the ignition wires could be directly engaged. Alternatively a screw driver or other tool may be inserted in the key slot and twisted in order to override the tumbler system associated with the ignition lock. In other words, as ignition locks are improved, those who wish to bypass the lock or override the lock develop new techniques and tools. An improved antitheft lock for an automobile is therefore a desirable product.

SUMMARY OF THE INVENTION

Briefly, the present invention relates to an improved ignition lock of the type including a cylinder with a rotatable plug therein. The improvement of the lock specifically relates to security features for the lock. Including among the improved security features is means for separating the cylinder plug into two portions in response to a torque applied to the plug, for example by a screw driver positioned in the key slot.

In addition, the improved ignition lock includes a key bolt which is normally biased to a first locking position and which is movable toward an unlocking position by means of the end of a key inserted in the key slot. A key when so inserted drives the key bolt out of locking engagement with the plug and cylinder permitting relative rotation. Additional security is provided by retainer slots which engage the key bolt upon over extension or translational movement thereof by a key or tool inserted in the key slot.

Thus, it is an object of the present invention to provide an improved lock particularly for use with an automotive ignition system.

Another object of the present invention is to provide an improved security lock resistent to picking and physical abuse or attack.

A further object of the present invention is to provide a lock having numerous improved security features.

Another object of the present invention is to provide an automobile ignition lock wherein the key blade length of the ignition key plays an important part in the locking function of the lock inasmuch as a key bolt must be pushed by the end of such a key to disengage the key bolt from locking notches in the cylinder.

Another object of the present invention is to provide a lock device wherein the plug associated with the cylinder of the lock includes torque responsive means enabling the plug to separate into distinct portions upon unauthorized attempts to force the lock by a torquing action.

Still another object of the present invention is to provide an improved ignition lock for automobiles having improved security at a minimum cost and with a minimum number of parts.

These and other objects, advantages and features of the invention will be set forth in the detailed description which follows.

BRIEF DESCRIPTION OF THE DRAWING

In the detailed description which follows a reference will be made to the drawing comprised of the following figures.

DESCRIPTION OF THE PREFERRED EMBODIMENT

Figure 2:
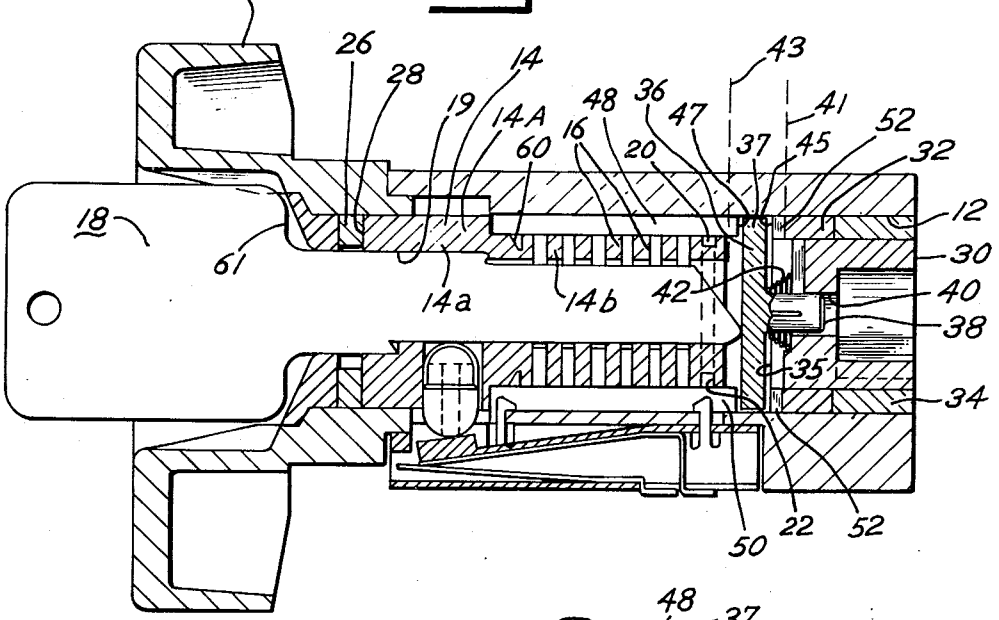
FIG. 2 is a side elevation, cross sectional view of the improved lock of FIG. 1 taken along the line 2—2.
Figure 3:
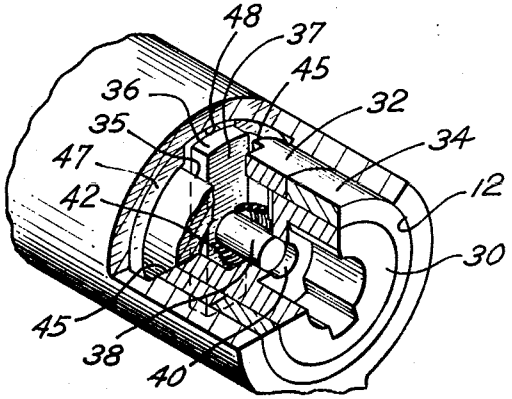
FIG. 3 is a cut-away perspective view of the key bolt locking feature of the improved lock.
Figure 1:
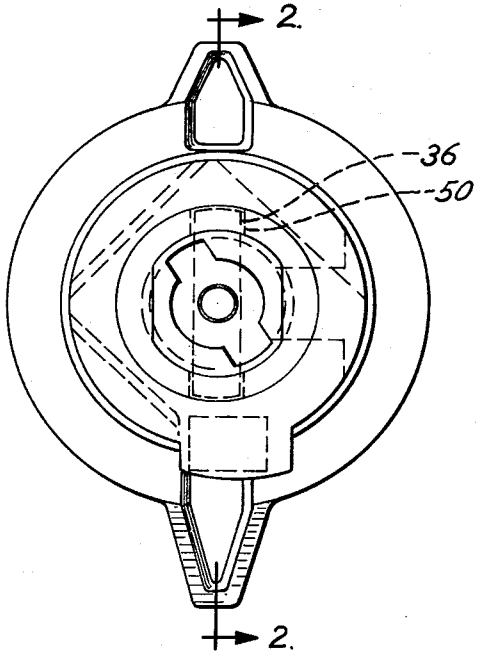
FIG. 1 is a rear end view of the improved lock of the present invention.

Referring to the figures, the improved ignition lock includes a cylinder 10 having a central passage 12. Typically, the cylinder 10 is rigidly mounted in a steering column of an automobile. A cylindrically shaped plug 14 is slidably inserted in the cylinder 10 and is rotatable with respect thereto whenever tumblers 16 and associated springs (not shown), comprising a tumbler mechanism, are properly oriented by a key 18 in a slot 19 of plug 14. A plug retainer 20 engages circumferential slot 22 to retain the plug 14 within passage 12 of cylinder 10.

A thumb turn 24 is attached to the plug 14 and rotates therewith in response to rotation of key 18. An anti-drill plate 26 of case hardened steel or the like is incorporated in an appropriate slot 28 at the front end of plug 14. The anti-drill plate 26 prevents drilling of and removal of the tumbler mechanism and thus the plug 14 from the cylinder 10.

The key 18 is received at the front end of the key slot 19. Key 18 extends through the slot 19 to the interior of the plug 14. The opposite or inner end 30 of the plug 14 cooperates with known mechanisms such as a rack and pinion for actuation of the automibile ignition circuit upon rotation of the plug 14 relative to the cylinder 10. End 30 thus comprises a portion of the driving means associated with plug 14.

An annular cylinder insert 32 surrounds the end of plug 14. A torque ring 34 is also included on the end of plug 14. Both ring 34 and insert 32 are nonrotatably attached to the cylinder 10.

Positioned within a slot 35 extending through plug 14 is a key bolt 36. Key bolt 36 includes a generally rectangular plate portion 37 and an integral, projecting stub or pivot bar 38 which extends into a concentric axial opening 40 in plug 14. A key bolt spring 42 is positioned between the plug 14 and key bolt 36 to bias the key bolt 36 along the longitudinal axis of the plug 14 towards the receiving or open end of key slot 19. The length of plate 37 is less than or equal to the inside diameter of cylinder 10 and is greater than the diameter of plug 14. The slot 35 in plug 14 extends in a longitudinal direction between plane 41 and plane 43. Thus plate portion 37 may be translated in slot 35 between planes 41 and 43. Note that planes 41 and 43 may be perpendicular or slightly angled with respect to the longitudinal axis of the lock. Plate 37 will be similarly angled.

The width of plate 37 is slightly less than the distance between forward insert wall 45 and cylinder wall 47. Thus, when key 18 is removed from key slot 19, key bolt 36, and more particularly plate 37, engages retainer slots 48 and 50 defined in the cylinder 10. Since plate 37 is in slot 35 rotation of the plug 14 relative to cylinder 10 is prevented. When a key 18 of appropriate length engages key bolt 36, bolt 36 moves against the force of spring 42 into position within plug slot 35 and also in the slot defined in cylinder 10 between walls 45 and 47 thereby permitting rotation of plug 14 and bolt 36. In the event the key 18 is of excessive length, then the key bolt 36 is projected into supplemental retainer slots 52 defined in the cylinder insert 32. In this manner, the plug 14 is again locked and prevented from rotation within the cylinder 10. Thus, the key 18 must be of an exact and proper length to move plate 37 and permit rotation of the plug 14 relative to cylinder 10.

Another of the improved features of the present invention relates to the circumferential notch 60 extending about the outside surface of plug 14. Notch 60 is positioned intermediate the tumblers 16 and the front end 61 of the key slot 15. In the event someone attempts to force rotation of the plug 14, for example, by insertion of a screw driver within slot 15, the plug 14 will fracture into separate portions 14*a* and 14*b*. Portion 14*a* will be rotatable independent of the lock portion 14*b*, thus preventing override. More than excess torque applied to the locking plug 14 will therefore cause the plug 14 to twist into two separate portions.

The above features along and in combination provide improved means which render an ignition lock pick proof and vandal proof. Of course, with time any anti-pick and anti-torque feature associated with a lock can be overcome. Nonetheless, the improved ignition lock construction of the present invention provides improved security and delays a breach of an automobile ignition system. Thus, while in the foregoing there has been set forth a preferred embodiment of the invention, it is to be understood that the invention shall be limited only by the following claims and their equivalents.

What is claimed is:

1. In a tumbler lock device of the type including a cylinder with a central passage, a generally cylindrical plug rotatably inserted in the passage, said plug including a key slot with a key receiving end, said plug also including a tumbler mechanism for locking the plug in fixed non-rotatable position relative to the cylinder, the tumbler mechanism being cooperative with a specific key to effect release of the tumbler mechanism and permit rotation of the plug thereby, and said plug also including driving means operated in response to rotation of the plug, the improvement of lock security means comprising torque responsive means in the plug responsive to threshold torque force on the locked plug to separate the plug into at least two portions, said torque responsive means comprising a circumferential slot on the outside surface of the plug, said slot defining a weakened section of the plug and a line of separation of plug portions upon application of torque to the plug and in excess of the threshold torque level, said slot being a separate slot intermediate the key receiving end and the tumbler mechanism.

2. The device of claim 1 including a key bolt in a slot in said plug and biased in a longitudinal direction parallel to the axis of rotation of said plug into engagement simultaneously with a recess defined in the passage of said cylinder and with the slot in said plug to thereby prevent rotation of the plug in the cylinder, said key bolt being longitudinally transported in the slot by placement of a key of proper length extending into the key slot to translate said key bolt to a non-interference position of said key bolt with said cylinder, said cylinder including a second key bolt engaging recess opposed to the first engaging recess whereby longitudinal displacement of the key bolt in the slot beyond the non-interference position also locks the plug in a non-rotatable position within the cylinder.

* * * * *